US011148463B2

(12) United States Patent
Crook et al.

(10) Patent No.: US 11,148,463 B2
(45) Date of Patent: Oct. 19, 2021

(54) PAINT LID AND CAN STORAGE SYSTEM AND METHOD OF USE

(71) Applicants: Dale J. Crook, Overland Park, KS (US); Richard G. Brull, North Kansas City, MO (US)

(72) Inventors: Dale J. Crook, Overland Park, KS (US); Richard G. Brull, North Kansas City, MO (US)

( * ) Notice: Subject to any disclaimer, the term of this patent is extended or adjusted under 35 U.S.C. 154(b) by 177 days.

(21) Appl. No.: 16/390,603

(22) Filed: Apr. 22, 2019

(65) Prior Publication Data

US 2019/0322125 A1 Oct. 24, 2019

Related U.S. Application Data

(60) Provisional application No. 62/660,333, filed on Apr. 20, 2018, provisional application No. 62/768,451, filed on Nov. 16, 2018.

(51) Int. Cl.
*B44D 3/14* (2006.01)
*B44D 3/12* (2006.01)

(52) U.S. Cl.
CPC ..... *B44D 3/125* (2013.01); *B44D 3/127* (2013.01); *B44D 3/128* (2013.01); *B44D 3/14* (2013.01); *B65D 2543/00092* (2013.01); *B65D 2543/00435* (2013.01)

(58) Field of Classification Search
CPC . B44D 3/14; B44D 3/16; B44D 3/162; B44D 3/164; B44D 3/125; B44D 3/127; B44D 3/128
USPC ..... 206/308.1; 220/699, 701, 375, 839
See application file for complete search history.

(56) References Cited

U.S. PATENT DOCUMENTS

| | | | | |
|---|---|---|---|---|
| 2,842,178 | A * | 7/1958 | Solomon | B65D 43/162 220/315 |
| 3,352,450 | A * | 11/1967 | Rawlins | B44D 3/128 220/571.1 |
| 3,786,982 | A * | 1/1974 | Rakes | B65D 1/26 229/406 |
| 4,998,696 | A * | 3/1991 | Desjardins | B44D 3/12 220/737 |
| 6,176,389 | B1 * | 1/2001 | de Laforcade | B44D 3/128 220/695 |
| 6,196,410 | B1 * | 3/2001 | Hocking | B44D 3/126 206/209 |
| 2016/0089929 | A1 * | 3/2016 | DePaola, Jr. | B44D 3/123 206/1.7 |

* cited by examiner

*Primary Examiner* — King M Chu
(74) *Attorney, Agent, or Firm* — Law Office of Mark Brown, LLC; Christopher M. De Backer

(57) ABSTRACT

A storage compartment formed from two halves designed to fit a paint lid, the two halves being connected by a living hinge or other suitable connection type. The two halves can be sealed over the paint lid. An optional magnet holds the storage compartment and lid to the bottom of the paint can, ensuring the lid remains in proximity to the paint can. A second magnet may also hold the lid in place within the storage compartment. Molded clasps or other closure elements are used to close the lid over the storage compartment. A rotatable arm can be tilted up from the storage compartment to allow for carrying of the open paint can along with the lid keeper storage compartment.

19 Claims, 11 Drawing Sheets

PAINT LID AND CAN STORAGE SYSTEM AND METHOD OF USE

CROSS-REFERENCE TO RELATED APPLICATION

This application claims priority in U.S. Provisional Patent Application No. 62/660,330 filed Apr. 20, 2018, and U.S. Provisional Application No. 62/768,451 filed Nov. 16, 2018, which are incorporated herein by reference.

BACKGROUND OF THE INVENTION

1. Field of the Invention

The present invention relates generally to a storage system and method for use thereof, and more specifically to a storage system for retaining a paint lid and paint can during use.

2. Description of the Related Art

When painting using standard cans of paint, there is presently not a good manner in which to keep the lid within proximity of the paint can without also subjecting the user and the surrounding environment to potentially accidental distribution of paint from the paint lid. Additionally, paint on paint lids tends to dry out, causing a bad seal when resetting the lid on the paint can. What is needed is a system for storing a paint lid while also keeping it in proximity to the can so that it is not misplaced or placed on the wrong can.

Heretofore there has not been available a system or method for a paint lid and can storage system with the advantages and features of the present invention.

BRIEF SUMMARY OF THE INVENTION

The present invention generally provides a storage compartment formed from two halves designed to fit a paint lid, the two halves being connected by a living hinge or other suitable connection type. The two halves can be sealed over the paint lid. An optional magnet holds the storage compartment and lid to the bottom of the paint can, ensuring the lid remains in proximity to the paint can. A second magnet may also hold the lid in place within the storage compartment. Molded clasps or other closure elements are used to close the lid over the storage compartment. A rotatable arm can be tilted up from the storage compartment to allow for carrying of the open paint can along with the lid keeper storage compartment.

At least one of the two halves include a lip located on its outside face for receiving a paint can and preventing drips from the paint can from hitting the ground. The magnet would hold the paint can in the center of the outside face so that there is a lip all the way around the base of the can.

The rotatable arm can include a wiper blade for cleaning off the paint brush. The rotatable arm can be rotated up such that this wiper blade is located above the opening of the paint can so that paint cleaned from the brush falls directly back into the paint can.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Paint can and Lid Storage System 2

As shown in FIGS. 1-11, the present invention provides a paint can and lid storage system 2 which is intended to both store the paint lid 28 to prevent accidental placement of wet paint from the paint lid, and to retain the paint lid 28 in proximity with the paint can 34.

Figure 1:
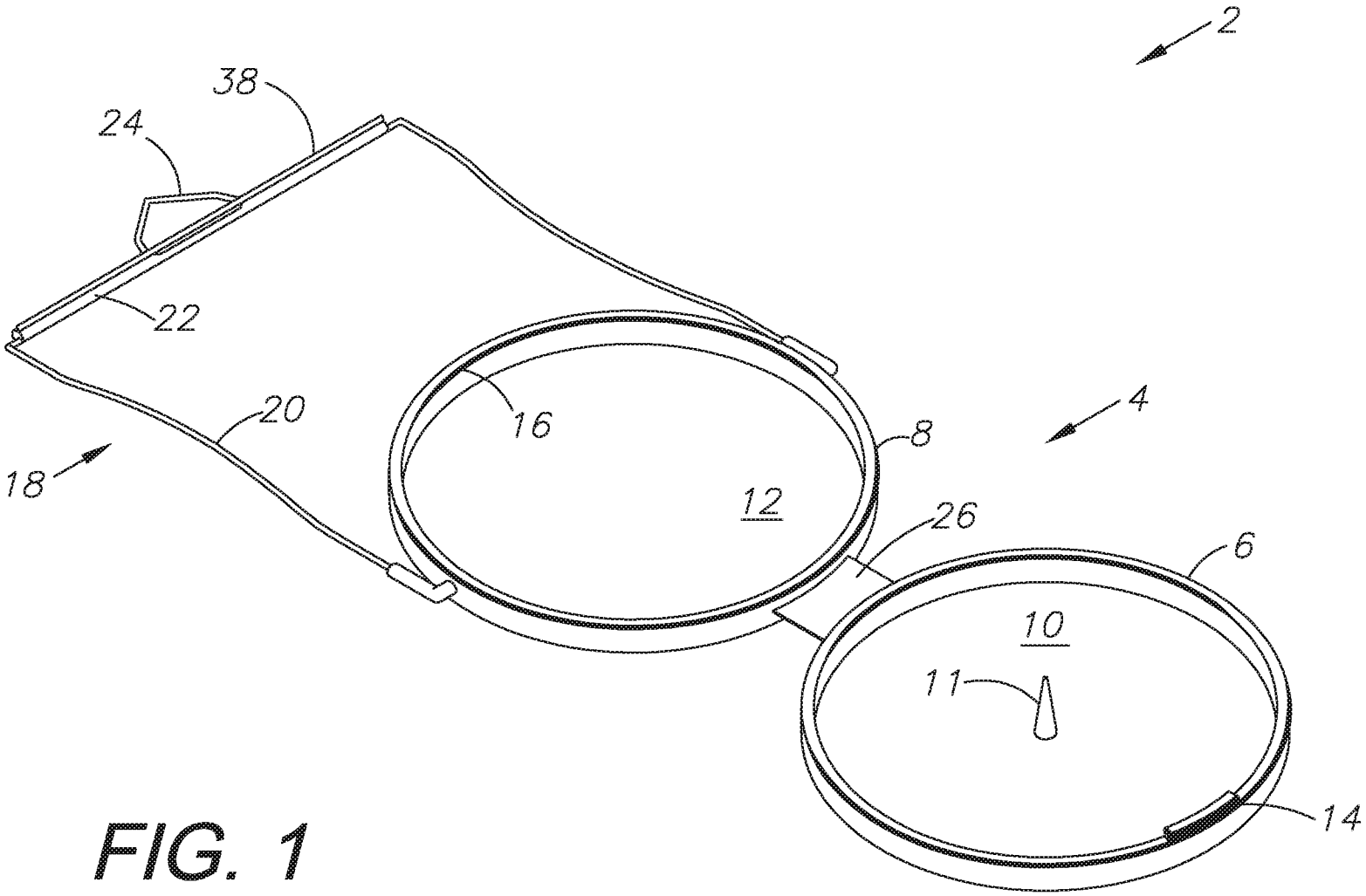
FIG. 1 is a three-dimensional isometric view of a preferred embodiment of the present invention shown in an open orientation.
Figure 2:
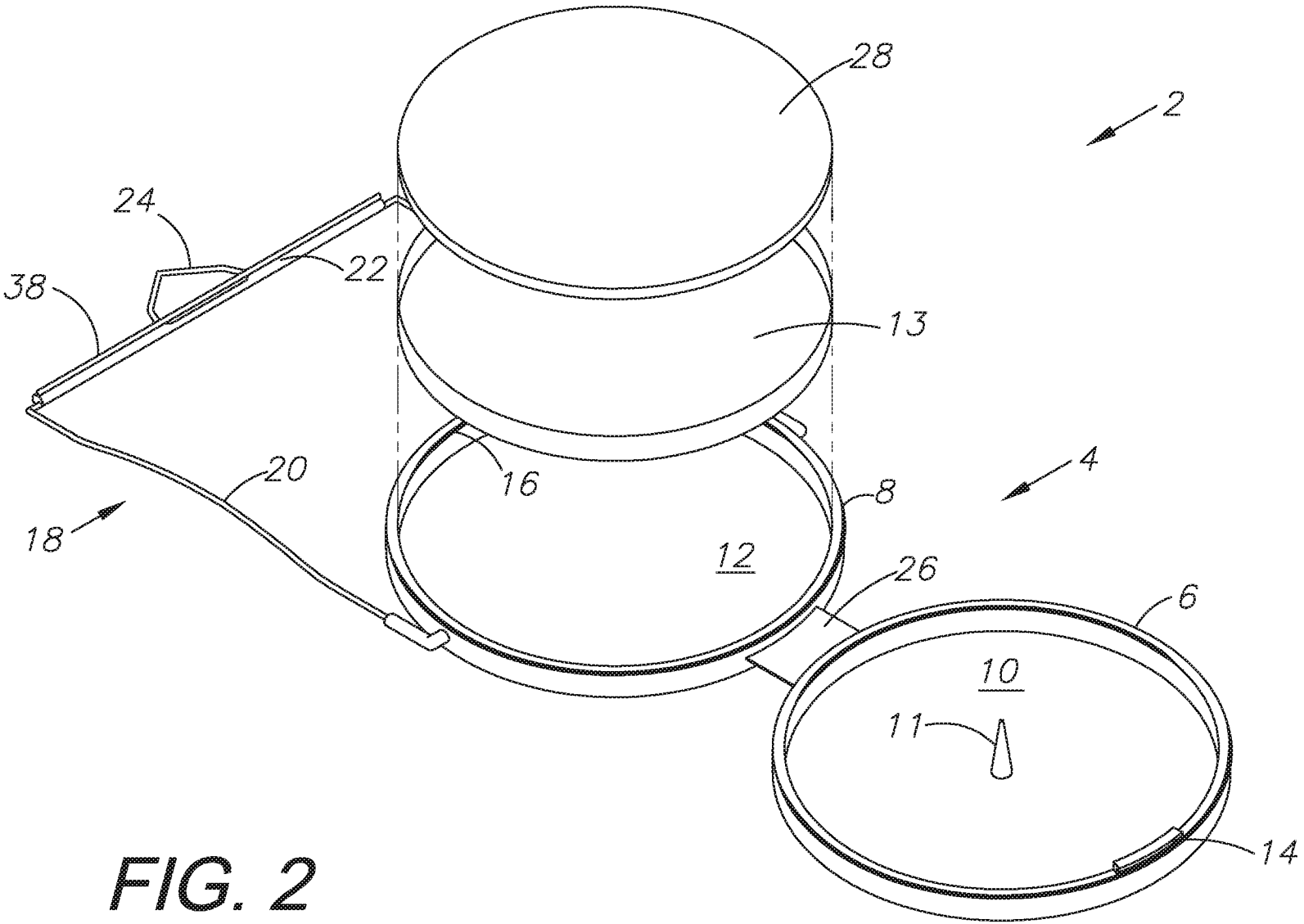
FIG. 2 is a three-dimensional isometric view thereof shown interacting with a paint lid environment.
Figure 3:
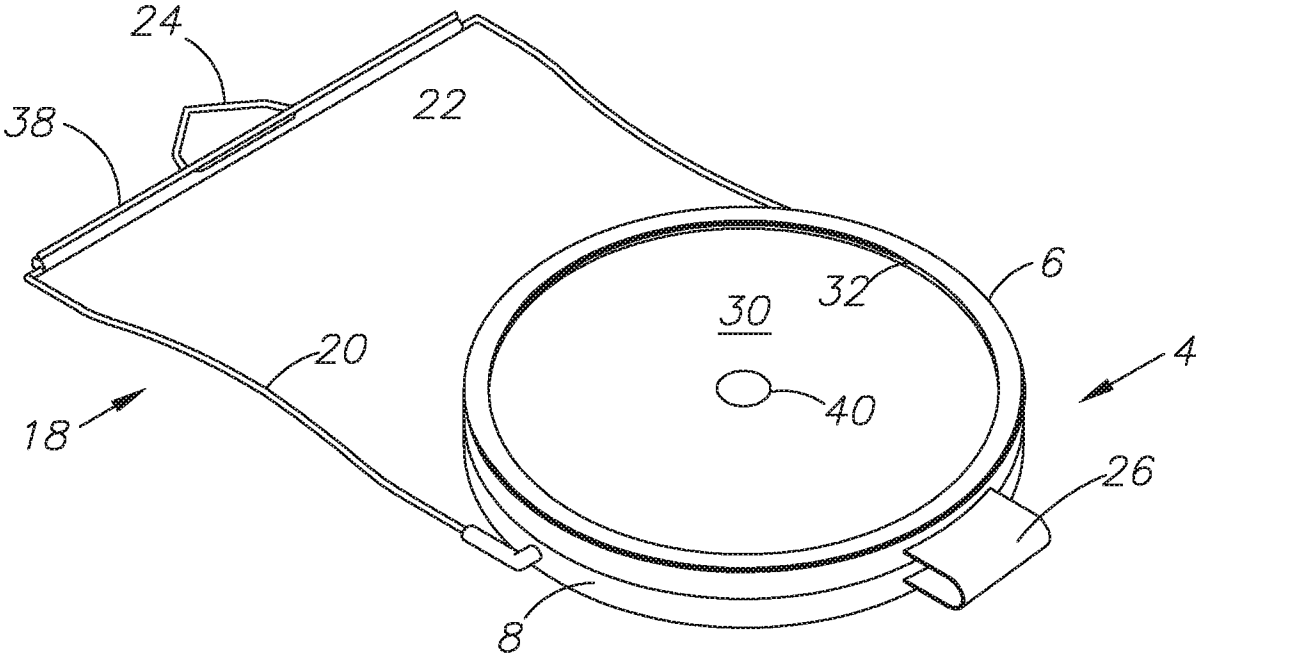
FIG. 3 is a three-dimensional isometric view thereof shown in a closed orientation.

The storage system 2 has a storage compartment 4 for retaining the paint lid 28. The storage compartment 4 has two halves 6, 8 designed to fit a paint can lid 28 within their respective interior spaces 10, 12, and is further configured for being moved from a first, open configuration as shown in FIG. 1 to a second, closed configuration as shown in FIG. 3. In the second, closed configuration the respective interior spaces 10, 12 of the two halves 6, 8, form a contiguous internal storage space 10, 12, The first half 6 and the second half 8 are joined via a living hinge 26 or other connection element. A clasp 14 or other securing element can ensure the two halves remain closed together when placed in the closed configuration. It could clip to a lip 16 of the second half 8, either on the inside or outside.

A magnet 40 located on one of the storage halves 6, 8 can be magnetically affixed to the base of the paint can 34. In this way, whenever the paint can is moved, the lid 28 stored within the storage compartment 4 is moved along with the paint can. The lid is contained within the storage compartment 4 and therefore cannot cause a mess. The exterior face 30 of one of the two halves 6, 8 of the storage compartment 4 may include a lip 32 raised around the edge to prevent spills of paint from the paint can. Similarly, a second magnet (not shown) could be used to retain the lid within the storage compartment of the second half 8 of the storage compartment 4 as well.

Figure 4:
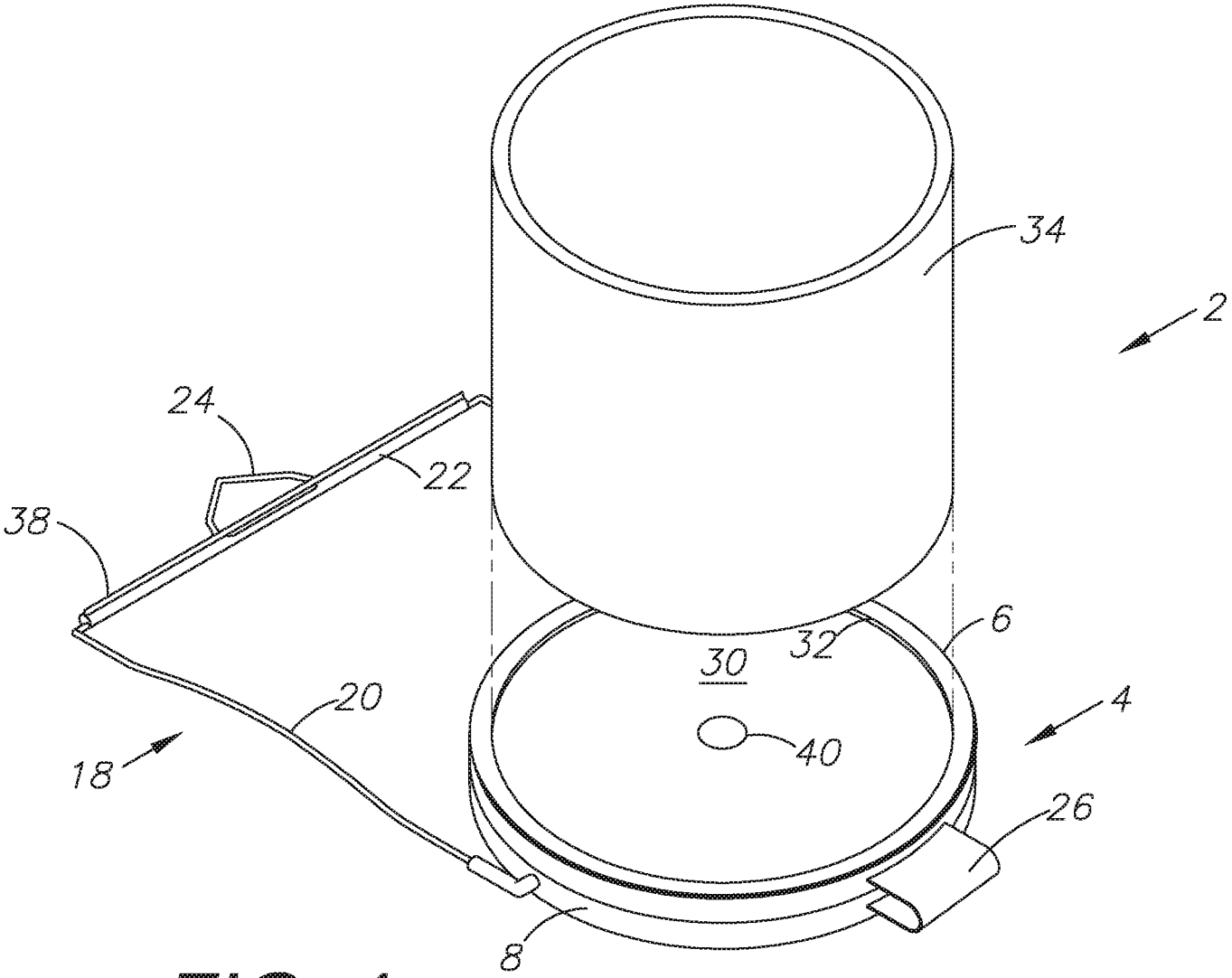
FIG. 4 is a three-dimensional isometric view thereof shown interacting with a paint can environment.
Figure 5:
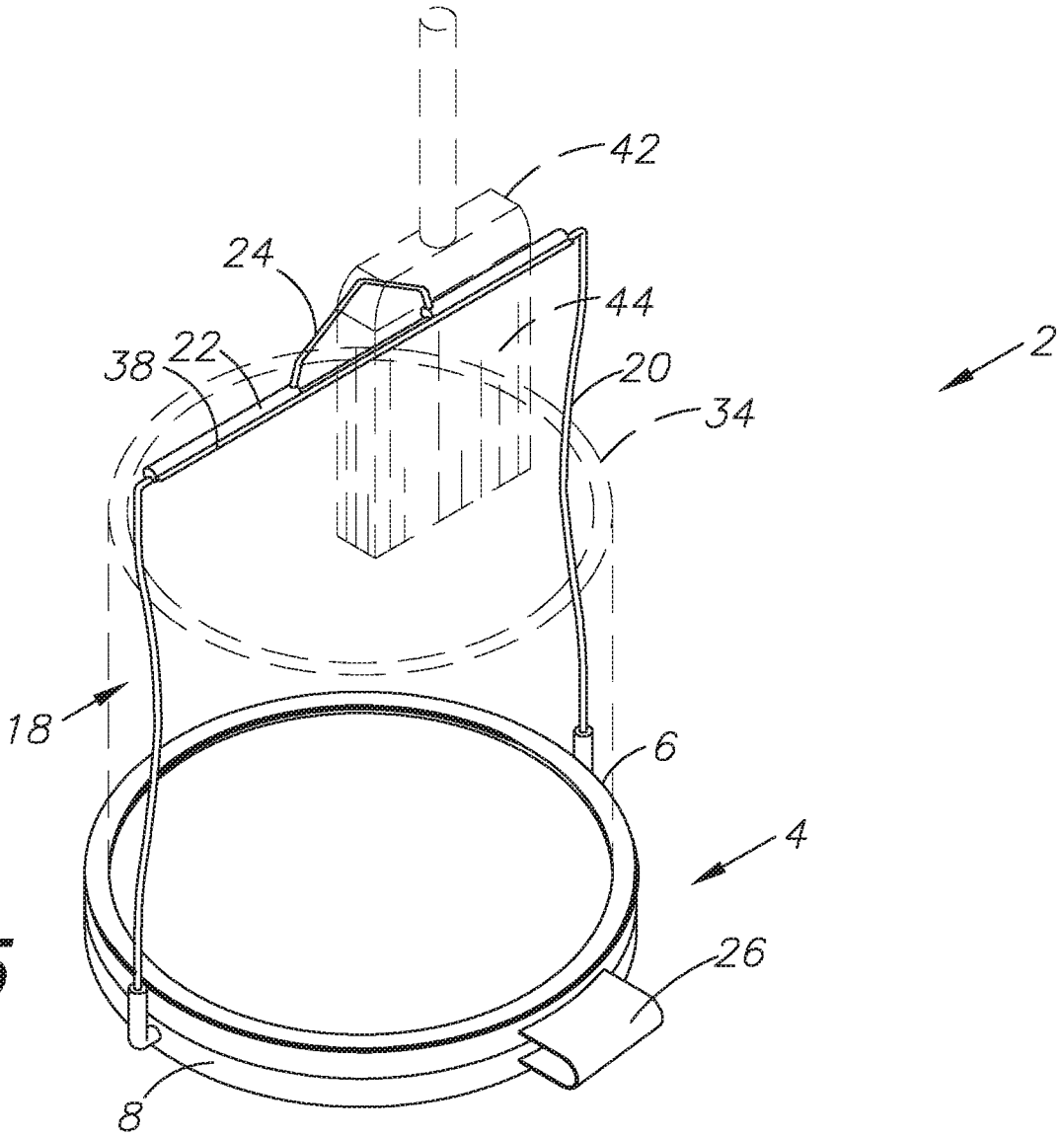
FIG. 5 is a three-dimensional isometric view thereof shown with a handle element thereof shown in a raised position.
Figure 6:
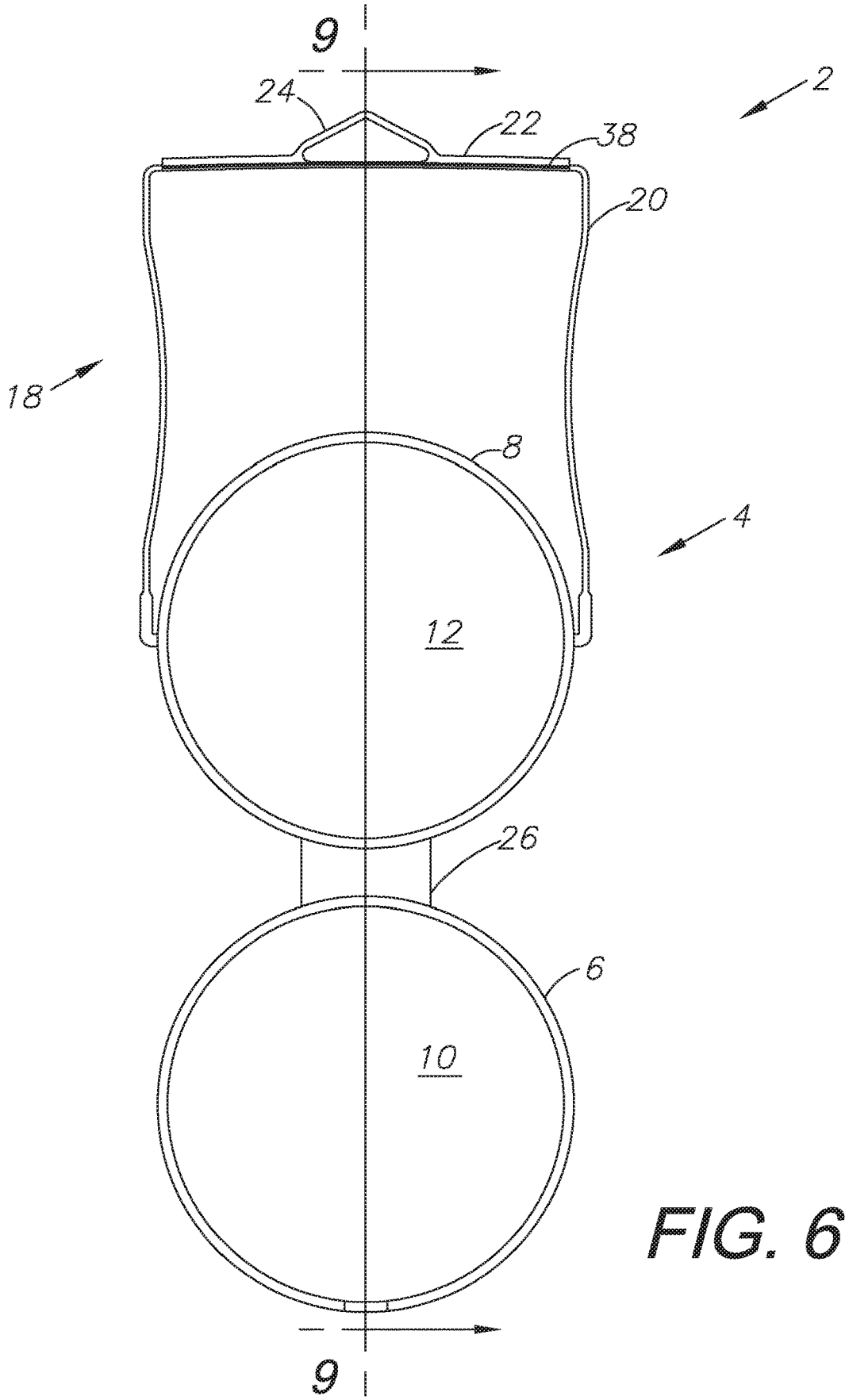
FIG. 6 is a top plan view of the embodiment thereof shown in an open orientation.
Figure 7:
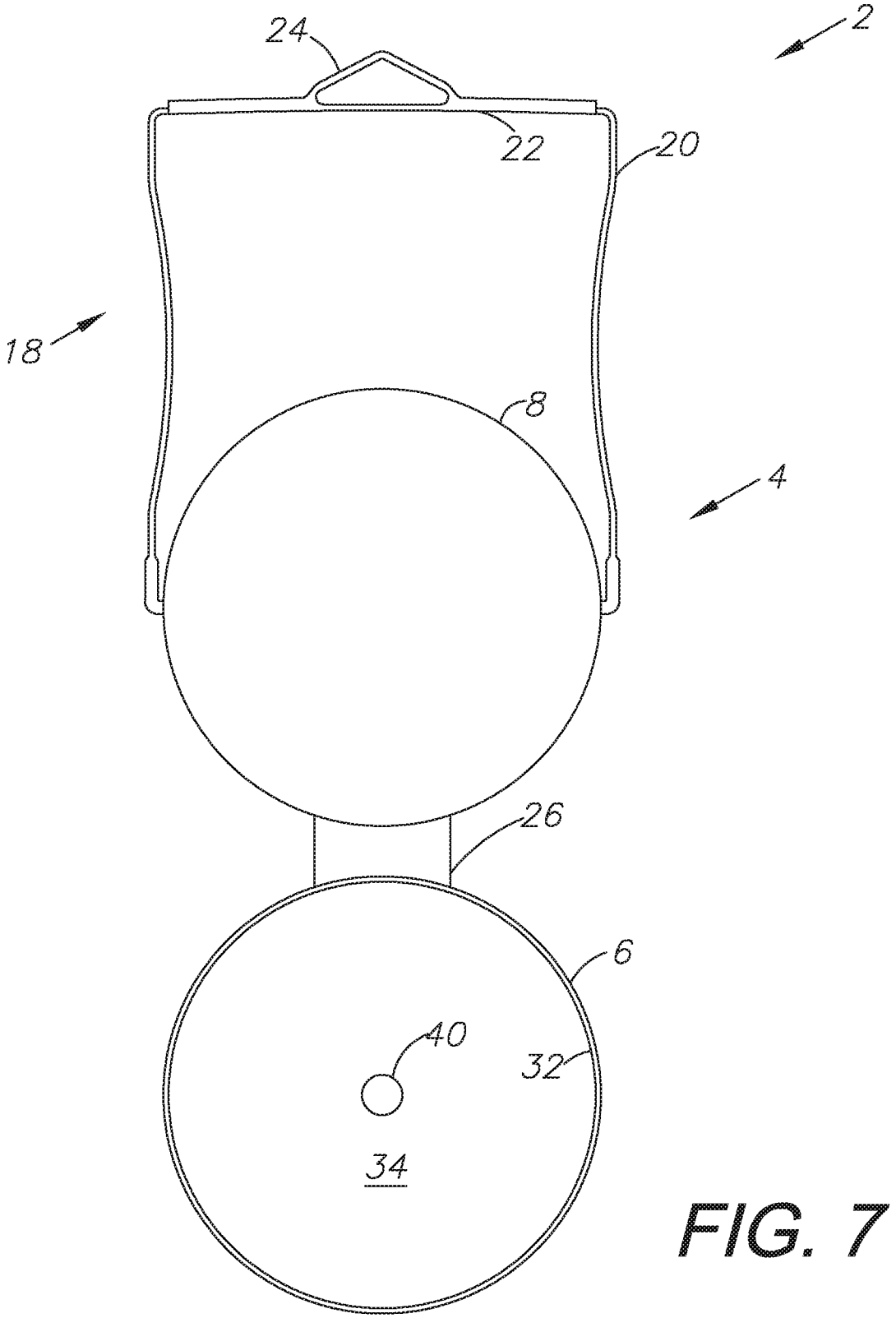
FIG. 7 is a bottom plan view thereof.
Figure 8:
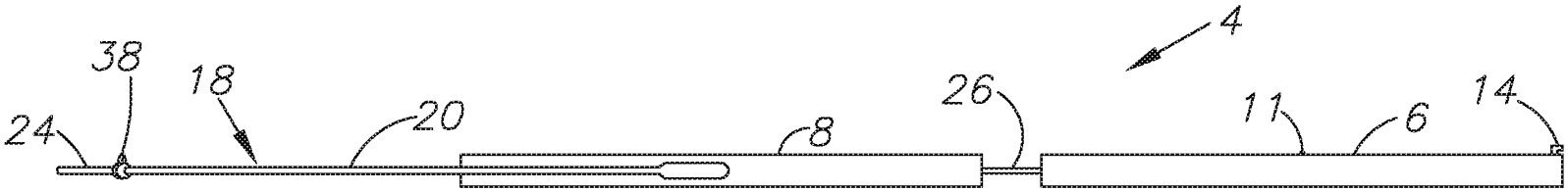
FIG. 8 is a side elevational view thereof.
Figure 9:
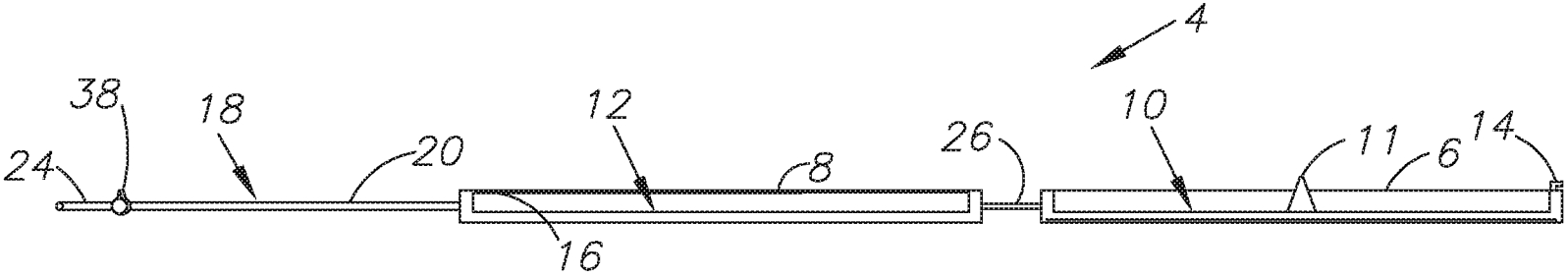
FIG. 9 is a side sectional view taken about the line of FIG. 6.
Figure 10:
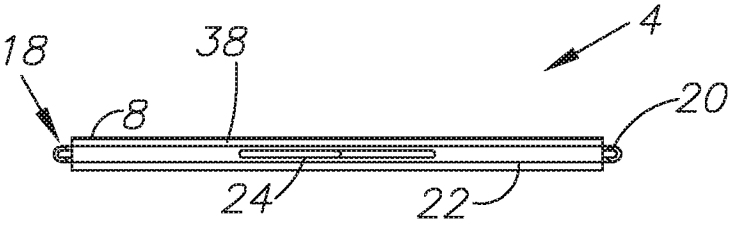
FIG. 10 is a front elevational view thereof.
Figure 11:
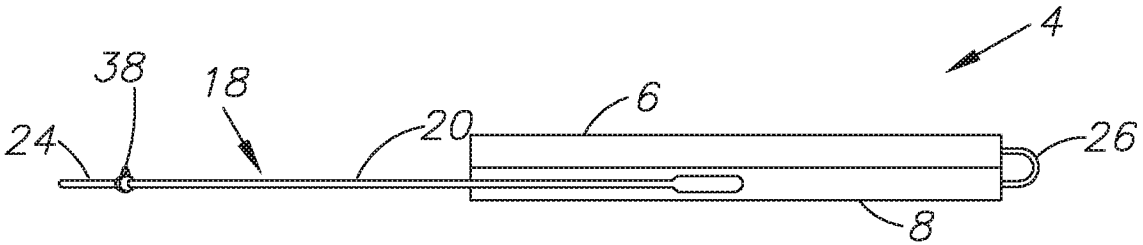
FIG. 11 is a side elevational view thereof shown in a closed orientation.

A rotatable keeper arm 18 is affixed to the storage compartment 4. This arm may be able to be rotated up to the top of the paint can 34 as shown in FIG. 4, allowing for easy carrying of the entire paint can 34, storage assembly 4, and stored lid 28. This keeper arm 18 also allows for easy keeping of paint tools within the can to prevent them from falling over or against the paint-covered edges of the paint can. The keeper arm 18 includes a pair of side connectors 20 joined at the top by a crossbar 22. A hanger tab 24 may be included to hang up the storage assembly 4. As shown in FIG. 5, a wiper blade 38 attached to the crossbar 22 can be used to clean paintbrush 42 bristles 44 over the top of the paint can 34.

Alternatively, molded fingers or flanges within the top of the storage lid could be used to grip the base of the paint can instead of using the magnet. Similar fingers or flanges could be used within the storage compartment to retain the lid as well.

The entire assembly of the storage compartment 4 and keeper arm 18 can be molded out of a single mold using a flexible plastic.

An optional peg 11 could be part of one of the halves of the storage compartment and would prevent the storage compartment from collapsing down onto the stored paint can lid when the paint can is placed atop the storage compartment.

An optional disposable liner 13 could be placed within the storage compartment 4 to make cleaning up paint from the lid easy.

III. Alternative Embodiment Paint Can and Lid Storage System 52

Figure 12:
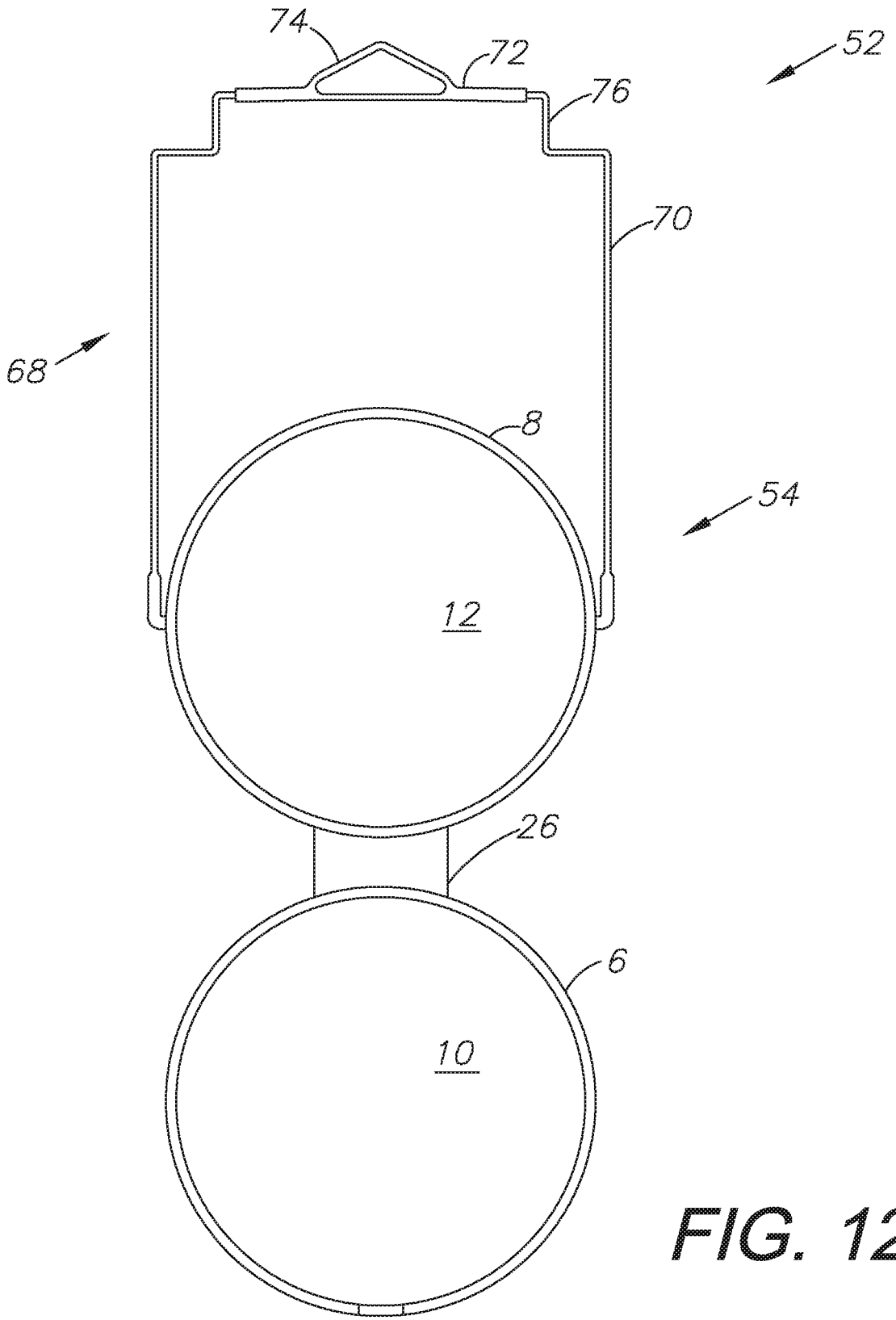
FIG. 12 is a top plan view of an alternative embodiment of the present invention.
Figure 13:
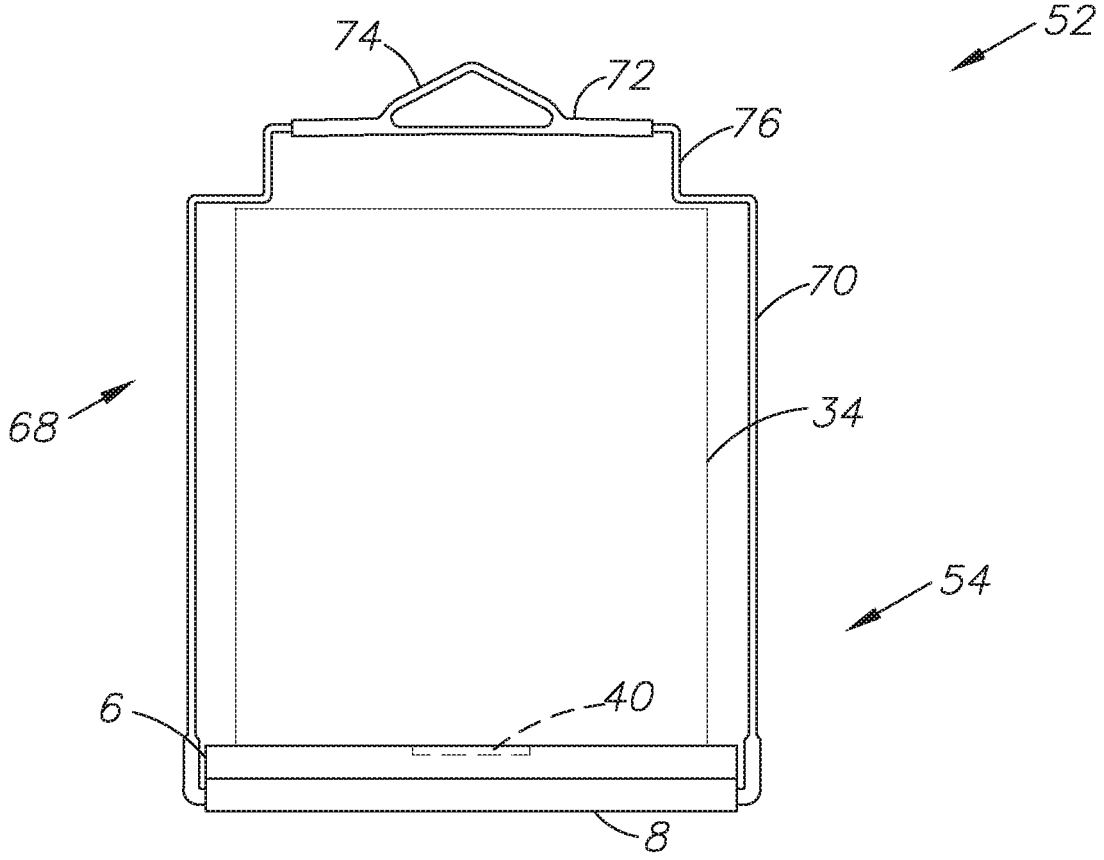
FIG. 13 is a side elevational view thereof, showing a handle element in a raised position.

FIGS. 12 and 13 show an alternative embodiment paint can and lid storage system 52 which uses an identical storage assembly 54 to the embodiment storage assembly 4 above, having two halves 6, 8, joined by a hinge 26. An alternative rotatable keeper arm 68 is connected to the storage assembly 54 is made out of a pair of side arms 70, a pair of steps 76, and a cross bar 72 having a hanging tab 74. A wiper blade may also be included. The steps 76 allow for the keeper arm 68 to clear the top of the paint can 34 as shown in FIG. 13 when the keeper arm 68 is raised.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A paint lid and can storage system comprising:

a storage compartment comprising a first half and a second half;

wherein said first half and said second half are configured to be transformed from a first, open configuration to a second, closed configuration, said first half and said second half further configured to form an internal storage space from respective first and second interior storage spaces when in said second, closed configuration;

said internal storage space configured for storing a paint lid; and said first half of said storage compartment comprising a linking element located on an exterior face of said first half of said storage compartment configured for retaining and attaching to a bottom of a paint can such that said storage compartment is physically attached and selectively linked to said bottom of said paint can.

2. The system of claim 1, further comprising:

a keeper arm affixed to said first half of said storage compartment, said keeper arm configured to be tilted about said first half and extended up around said paint can; and said keeper arm comprising a pair of side arms joined by a crossbar.

3. The system of claim 2, further comprising a wiper blade affixed to said crossbar, said wiper blade configured for removing paint from paint brush bristles of a paint brush dragged across said wiper blade; and said keeper arm configured to be rotated above an opening of said paint can such that said paint removed from said paint brush bristles drops into said opening.

4. The system of claim 2, wherein said crossbar comprises a hanging tab configured for hanging said keeper arm and storage compartment.

5. The system of claim 1, further comprising a magnet configured for retaining said paint lid within said internal storage space.

6. The system of claim 1, further comprising a clasp located on said second half, said clasp configured for securing said first half to said second half when in said second, closed configuration.

7. The system of claim 1, wherein a connector connects said first half and said second half, wherein said connector comprises a living hinge.

8. The system of claim 1, wherein further comprising a connector joining said first half and said second half.

9. The system of claim 1 wherein said linking element comprises a magnet.

10. The system of claim 1 further comprising a peg located on an interior face of said first half, said peg configured to prevent said first half from depressing into said internal space when said paint can is placed atop said first half.

11. The system of claim 1 including a disposable liner configured to be removably placed within said internal space of said storage compartment.

12. A paint lid and can storage system comprising:

a storage compartment comprising a first half and a second half;

a connector joining said first half and said second half;

wherein said first half and said second half are configure to be transformed from a first, open configuration to a second, closed configuration, said first half and said second half further configured to form an internal storage space from respective first and second interior storage spaces when in said second, closed configuration;

said internal storage space configured for storing a paint lid;

said first half of said storage compartment comprising a magnet and a lip configured for retaining and attaching to a bottom of a paint can;

a keeper arm affixed to said first half of said storage compartment, said keeper arm configured to be tilted about said first half and extended up around said paint can;

said keeper arm comprising a pair of side arms joined by a crossbar;

a wiper blade affixed to said crossbar, said wiper blade configured for removing paint from paint brush bristles of a paint brush dragged across said wiper blade;

said keeper arm configured to be rotated above an opening of said paint can such that said paint removed from said paint brush bristles drops into said opening; and said crossbar further comprises a hanging tab configured for hanging said keeper arm and storage compartment.

13. The system of claim 12, wherein said keeper arm, said storage compartment, and said connector are molded from a plastic material using a single mold.

14. A method of organizing a paint can and paint lid, the method comprising the steps:

removing a paint lid from a paint can;

placing said paint lid within a storage compartment comprising a first half and a second half joined together via a connector;

closing said storage compartment about said paint lid, securing said first half to said second half;

placing a bottom face of said paint can onto an exterior face of said first half, said first half comprising a magnet configured for magnetically affixing said first half to said bottom face of said paint can;

painting with a paint brush using paint from said paint can;

removing said paint can from said exterior face of said first half;

opening said storage compartment;

removing said paint lid; and replacing said paint lid onto said paint can.

15. The method of claim 14, further comprising the steps:

rotating a keeper arm affixed to said second half of said storage compartment up over said paint can, said keeper arm comprising a pair of side arms joined by a crossbar; and cleaning bristles of said paint brush against a wiper blade affixed to said crossbar such that paint cleaned from said bristles drops into an opening of said paint can located below said crossbar.

16. The method of claim 14, wherein said exterior face of said first half further comprises a lip configured for catching paint spilt from said paint can.

17. The method of claim 14, further comprising the step:

securing said paint lid to said storage compartment with a magnet, said magnet located within said second half of said storage compartment.

18. The method of claim 14, further comprising the steps:

placing a disposable liner within said storage compartment, said disposable liner configured to prevent paint from said paint can lid from spoiling said storage compartment; and removing and disposing of said disposable liner.

19. The method of claim 14, further comprising the steps:

preventing, with a peg, said first half of said storage compartment from partially collapsing towards said second half of said storage compartment when said paint can is placed atop said first half.

* * * * *